US012221676B2

(12) United States Patent
Miwa et al.

(10) Patent No.: US 12,221,676 B2
(45) Date of Patent: Feb. 11, 2025

(54) PHOTOLUMINESCENT ALUMINUM ALLOY AND PHOTOLUMINESCENT ALUMINUM ALLOY DIE-CAST MATERIAL

(71) Applicants: NIPPON LIGHT METAL COMPANY, LTD., Tokyo (JP); NIKKEI MC ALUMINIUM CO., LTD., Tokyo (JP)

(72) Inventors: Shinya Miwa, Aichi (JP); Katsumi Fukaya, Aichi (JP); Hiroshi Horikawa, Tokyo (JP); Izumi Yamamoto, Shizuoka (JP)

(73) Assignees: NIPPON LIGHT METAL COMPANY, LTD., Tokyo (JP); NIKKEI MC ALUMINUM CO., LTD., Tokyo (JP)

( * ) Notice: Subject to any disclaimer, the term of this patent is extended or adjusted under 35 U.S.C. 154(b) by 144 days.

(21) Appl. No.: 17/639,150

(22) PCT Filed: Jun. 16, 2020

(86) PCT No.: PCT/JP2020/023563
§ 371 (c)(1),
(2) Date: Feb. 28, 2022

(87) PCT Pub. No.: WO2021/044700
PCT Pub. Date: Mar. 11, 2021

(65) Prior Publication Data

US 2022/0316034 A1 Oct. 6, 2022

(30) Foreign Application Priority Data

Sep. 3, 2019 (JP) ..... 2019-160338

(51) Int. Cl.
*C25D 11/08* (2006.01)
*C22C 21/00* (2006.01)
*C22C 21/10* (2006.01)
*C25D 11/14* (2006.01)
*C25D 11/16* (2006.01)

(52) U.S. Cl.
CPC ..... *C22C 21/10* (2013.01); *C22C 21/00* (2013.01); *C25D 11/14* (2013.01); *C25D 11/16* (2013.01); *C25D 11/08* (2013.01)

(58) Field of Classification Search
None
See application file for complete search history.

(56) References Cited

FOREIGN PATENT DOCUMENTS

| | | | | |
|---|---|---|---|---|
| CN | 105316533 A | * | 2/2016 | |
| CN | 106854719 A | * | 6/2017 | |
| CN | 108060332 A | * | 5/2018 | ..... C22C 1/03 |
| CN | 111101025 A | * | 5/2020 | |

OTHER PUBLICATIONS

Runge, Jude Mary. "Anodizing". ASM Handbook, vol. 2A, Aluminum Science and Technology, p. 590-605. (Year: 2018).*

* cited by examiner

*Primary Examiner* — George Wyszomierski
*Assistant Examiner* — Janell C Morillo
(74) *Attorney, Agent, or Firm* — RANKIN, HILL & CLARK LLP

(57) ABSTRACT

The present invention provides a photoluminescent aluminum alloy which exhibits high mechanical properties and which suppresses, to a high degree, the occurrence of color unevenness in cases where a tungsten-containing aluminum alloy die-cast material is subjected to anodization. Also provided is a photoluminescent aluminum alloy die-cast material produced using the photoluminescent aluminum alloy. This aluminum alloy contains 0.5-3.0 mass % of Mn, 0.3-2.0 mass % of Mg, 0.01-1.0 mass % of W and 1.0-3.0 mass % of Zn, with the remainder comprising aluminum and unavoidable impurities.

6 Claims, No Drawings

PHOTOLUMINESCENT ALUMINUM ALLOY AND PHOTOLUMINESCENT ALUMINUM ALLOY DIE-CAST MATERIAL

TECHNICAL FIELD

The present invention relates to a photoluminescent aluminum alloy and a photoluminescent aluminum alloy die-cast material using the photoluminescent aluminum alloy.

PRIOR ARTS

An aluminum alloy material is used for the housings of portable electronic devices and electronic terminals, because it is lightweight and has an excellent texture. Further, an aluminum alloy material may be partially used for the purpose of improving the design of the product appearance.

With respect to the texture of the aluminum alloy material, for example, by forming an oxide layer on the surface of the aluminum alloy material by anodizing treatment, in addition to improving the photoluminescentness and corrosion resistance, it is possible to color the aluminum alloy material as occasion demand. Further, in many cases, since the anodic oxide film has a higher hardness than the surface of the aluminum alloy material, it can be suitably used as an exterior material where it can impart resistance to scratches and the like.

As the interest of users in product appearance increases, so does the demand for exterior materials increases. Specifically, in addition to the light weight and texture conventionally required for aluminum alloy materials, durability against the stress applied to electronic devices and electronic terminals carried according to the movement of the owner, robustness that can withstand the unexpected dropping, and workability to form an aesthetically pleasing shape are also required, and in order to adapt these requirements, aluminum alloys with excellent mechanical properties are now being developed.

Further, since there is a demand for weight reduction and improvement of durability while maintaining consistency with the previously adopted aluminum alloy in terms of texture and color tone of the final product, it is also important not only to improve the strength, but also to exhibit the same texture and color tone as the existing alloy after the anodizing treatment.

As described above, in the present technical field, it cannot be simply said that it is an absolutely excellent material as long as it has high mechanical properties and develops a beautiful color after anodizing treatment, and there is a technical feature that it is necessary to raise the mechanical properties such as strength as much as possible while ensuring the consistency of the texture and color tone.

As the conventional photoluminescent aluminum alloys, for example, in Patent Literature 1 (Japanese Patent Examined Publication No. S56-31854), there is disclosed an aluminum alloy for die-cast which contains 1.2 to 4.0% of manganese, 0.2 to 1.5% of iron, 0.05 to 1.0% of tungsten and 0.02 to 0.3% of titanium by weight, and balance being aluminum and unavoidable impurities. The aluminum alloy is said to be an aluminum alloy for die casting that has less seizure during die casting, has good mold releasability, and has good corrosion resistance, surface treatment properties, and mechanical properties.

Further, in Patent Literature 2 (Japanese Patent Examined Publication No. S56-31855), there is disclosed an aluminum alloy for die-cast which contains 1.2 to 2.8% of manganese, 0.2 to 1.5% of iron, 0.1 to 1.35% of chromium, 0.05 to 1.0% of tungsten and 0.02 to 0.3% of titanium by weight, and balance being aluminum and unavoidable impurities. The aluminum alloy is said to be an aluminum alloy for die casting that has less seizure during die casting, has good mold releasability, and has good corrosion resistance, surface treatment properties, and mechanical properties.

CITATION LIST

Patent Literature

Patent Literature 1: Japanese Patent Examined Publication No. S56-31854

Patent Literature 2: Japanese Patent Examined Publication No. S56-31855

SUMMARY OF THE INVENTION

Technical Problem

Tungsten is contained in both the aluminum alloys for die-cast disclosed in Patent Literature 1 and Patent Literature 2. It is known that, in addition to that tungsten tends to give a reddish-red color in anodizing treatment with a sulfuric acid bath and a golden color in anodizing treatment with an oxalic acid bath to the anodic oxide film, the aluminum alloys containing tungsten bring about vivid and uniform color development, when being subjected to dyeing treatment, and improvement of mechanical properties is eagerly desired.

Here, though there are a wide variety of textures and colors that can be imparted to the aluminum alloy material by using an anodic oxide film or by additionally applying a coloring treatment to the anodic oxide film, it is difficult to realize all textures and colors. Factors that affect the texture and color development include the composition of the aluminum alloy, anodizing treatment conditions, coloring treatment conditions, and the like, and various color tones and the like can be realized for the first time by appropriately combining these factors. For example, in order to select an aluminum alloy composition that satisfies the characteristics such as predetermined strength and to obtain a desired texture and color development, even if they are capable mechanical properties and color tones, the aforementioned factors are adjusted, which results in necessity of repeating a huge amount of trial and error with a great deal of difficulty.

Also, as a general rule, when adjusting the alloy composition to increase the strength, the intermetallic compound that is formed inevitably changes. Since the color tone of the anodic oxide film usually changes in a complicated manner depending on the type and amount of the intermetallic compound in the base aluminum alloy material, the structure morphology, the type and amount of the solidifying element, and the like, it is also not easy to change the mechanical properties of the aluminum alloy material while maintaining the same color tone when comparing after the anodizing treatment.

The aluminum alloys disclosed in Patent Literature 1 and Patent Literature 2 have a tensile property of 0.2% proof stress of about 100 MPa or more in many examples. It seems as if an aluminum alloy member having sufficiently high proof stress and capable of providing a beautiful anodic oxide film has been realized. However, the mold shape used for die casting in the examples is a simple plate shape of 100 mm (L)×100 mm (W)×2 mm (t), and under such die casting conditions, a variation of the cooling rate at each member position is relatively small, so that it cannot be said that the state of occurrence of color unevenness when the anodizing treatment is performed in the actual product shape can be sufficiently simulated.

In fact, with respect to the aluminum ally compositions described in the examples of Patent Literature 1 and Patent Literature 2, the present inventors have performed die casting with a mold having the complexity of the shape level of actual products such as electronic devices and electronic terminals that are becoming smaller and more complex in shape, and the obtained member was anodized. As a result, color unevenness occurred due to variations in the concentration of the contained elements and variations in alloy structure morphology, etc. depending on different cooling rates depending on the position, and thus the product could not be used as a product. Therefore, when manufacturing an actual product, by adjusting the components that contribute to the strength of the aluminum alloy such as Mn and Fe near the lower limit value of the component range shown in Patent Literature 1 and Patent Literature 2, the variations of the concentration of the contained elements and the structure of the intermetallic compound depending on the position of the member were reduced, and the occurrence of color unevenness had to be suppressed.

However, when an alloy composition that does not cause color unevenness is employed, since the mechanical properties such as a tensile property of 0.2% proof stress are lower than the values described in the examples, it is not possible to satisfy the demand for mechanical properties that are increasing more and more in recent years is required.

In view of the aforementioned problems in the prior art, an object of the present invention is to provide a photoluminescent aluminum alloy which has high mechanical properties and in which the occurrence of uneven color is also suppressed to a high degree when an aluminum alloy die-cast material including tungsten is subjected to anodization treatment. Also provided is a photoluminescent aluminum alloy die-cast material that is manufactured by using the photoluminescent aluminum alloy.

Solution to Problem

As a result of intensive studies on the composition range of the aluminum alloy for die casting and the structure of the aluminum alloy die-cast material in order to achieve the above object, the present inventors have found that, in an aluminum alloy die-cast material containing an appropriate amount of tungsten, it is extremely effective to strictly control the addition amounts of Mn, Mg and Zn, which are elements that improve mechanical properties, and have reached the present invention.

Namely, the present invention can provide an aluminum alloy, containing;

Mn: 0.5 to 3.0% by mass,

Mg: 0.3 to 2.0% by mass,

W: 0.01 to 1.0% by mass,

Zn: 1.0 to 3.0% by mass, with the remainder comprising aluminum and unavoidable impurities.

It is preferable that the aluminum alloy of the present invention has a Mn content of 1.0 to 2.0% by mass, a Mg content of 0.5 to 1.5% by mass, and a Zn content of 1.5 to 2.5% by mass.

By controlling the addition amount of Mn, Mg and Zn within these ranges, the aluminum alloy die-cast material has a high proof stress and high hardness without impairing the color development of the anodic oxide film formed by the anodizing treatment of the aluminum alloy containing tungsten.

In the aluminum alloy of the present invention, it is preferable to further contain one or more of Ti: 0.01 to 0.5% by mass, B: 0.001 to 0.2% by mass, and Zr: 0.01 to 0.5% by mass.

By adding these additive elements, the metal structure of the aluminum alloy die-cast material can be made finely uniform, and the occurrence of casting cracks and color unevenness after anodizing treatment can be suppressed.

The present invention also provides an aluminum alloy die-cast material, which is made of the aluminum alloy of the present invention and has a tensile property of 0.2% proof stress of 100 MPa or more. Since the aluminum alloy die-cast material of the present invention contains Mn, Mg and Zn that contribute to the improvement of a tensile property of 0.2% proof stress, it is possible to realize a tensile property of 0.2% proof stress of 100 MPa or more. Here, the 0.2% proof stress is preferably 105 MPa or more, more preferably 110 MPa or more.

The aluminum alloy die-cast material of the present invention preferably has a Vickers hardness of 60 or more. When the Vickers hardness of the aluminum alloy die-cast material is 60 or more, since, in addition that it is possible to suppress the deformation at the time of mold release even in the part where the thickness must be thin due to the shape of the product, and the formation of screw holes, etc. and is possible to impart the workability required for precision machining, it can be suitably used as various housings.

Further, in the aluminum alloy die-cast material of the present invention, it is preferable that the granular crystal region formed by the primary crystal $\alpha$ particles having a maximum ferret diameter of 10 μm or more occupies 90% or more of the surface area ratio of the member surface. Further, in order to realize more uniform color development during dyeing, it is more preferable that the granular crystal region formed by the primary crystal $\alpha$ particles having a maximum ferret diameter of 10 μm or more occupies 95% or more of the surface area ratio of the member surface.

Furthermore, it is preferable that the aluminum alloy die-cast material of the present invention is provided with an anodic oxide film of about 5 μm formed by anodizing treatment without dyeing by using a sulfuric acid bath, and, in the color measurement of the surface of the anodic oxide film, when using the CIE standard illuminant D65 as the light source, it is preferable that the L* value is 70 or more, the a* value is 0 to 2, and the b* value is 1 to 4. In the color measurement of the surface provided with the anodic oxide film of about 5 μm, when the aluminum alloy die-cast material has these values, the appearance of a beautiful color tone can be obtained.

Effects of the Invention

According to the present invention, it is possible to provide a photoluminescent aluminum alloy which has high mechanical properties and in which the occurrence of uneven color is also suppressed to a high degree when an aluminum alloy die-cast material including tungsten is subjected to anodization treatment. Also provided is a photoluminescent aluminum alloy die-cast material that is manufactured by using the photoluminescent aluminum alloy.

Embodiments for Achieving the Invention

Hereinafter, typical embodiments of the photoluminescent aluminum alloy and the photoluminescent aluminum alloy die-cast material of the present invention will be described in detail, but the present invention is not limited to these.

1. Aluminum Alloy

The aluminum alloy of the present invention is an aluminum ally which contains Mn: 0.5 to 3.0% by mass, Mg: 0.3 to 2.0% by mass, W: 0.01 to 1.0% by mass, Zn: 1.0 to 3.0% by mass, with the remainder comprising aluminum and unavoidable impurities. Hereinafter, each component will be described in detail.

(1) Additive Elements

Mn: 0.5 to 3.0% by Mass

Mn affects color development at the anodizing treatment, and forms an Al—Mn-based intermetallic compound to contribute to the proof stress, an in addition, thereto, is added for the purpose of preventing seizure of molten metal on the mold during casting. When Mn is less than 0.5% by mass, since it is not possible to prevent the molten metal from being seized onto the mold during the casting, the lower limit value of Mn is 0.5% by mass. On the other hand, when added in an amount of more than 3.0% by mass, since the Al—Mn-based intermetallic compound grows coarsely and casting cracks occur, so that the upper limit value of Mn is 3.0% by mass. In order to perform casting to give a better quality, the upper limit value is preferably 2.2% by mass, more preferably 2.0% by mass. The lower limit value is preferably 1.2% by mass, more preferably 1.5% by mass.

Mg: 0.1 to 2.0% by Mass

Mg is added for contributing to strength by forming a η' phase, or a η' phase and a T' phase together with Zn, which will be described later, after artificial aging. When the Mg content is less than the lower limit value, the effect of improving the strength is not sufficient, and when added in excess of the upper limit value, casting cracking will occur. Therefore, the upper limit value of Mg is limited to 2.0% by mass, and the lower limit value is limited to 0.3% by mass. From the same viewpoint, the upper limit value is preferably 1.5% by mass, and the lower limit value is preferably 0.5% by mass.

Zn: 1.0 to 3.0% by Mass

Zn is added for contributing to strength by forming a η' phase, or a η' phase and a T' phase together with the Mg after artificial aging. When the Zn content is less than the lower limit value, the effect of improving the strength is not sufficient, and when added in excess of the upper limit value, since the anodic oxide film becomes yellowish and, in addition thereto, the color unevenness occurs after the anodizing treatment by segregating the concentration of Zn, the upper limit value of Zn is limited to 3.0% by mass, and the lower limit value is limited to 1.0% by mass. From the same viewpoint, the upper limit value is preferably 2.5% by mass, and the lower limit value is preferably 1.5% by mass.

W: 0.01 to 1.0% by Mass

W is added to obtain vivid and uniform color development which is the end of the present invention, in addition to giving a reddish-red color in anodizing treatment with a sulfuric acid bath and a golden color in anodizing treatment with an oxalic acid bath to the anodic oxide film in the color development after the anodizing treatment. When the W content is less than the lower limit value, the above effect is not sufficient, and when added more than 1.0% by mass, the alloy cost will increase, and therefore, the upper limit value is 1.0% by mass and the lower limit value is 0.01% by mass.

In addition, one or more of Ti: 0.01 to 0.5% by mass, B: 0.001 to 0.2% by mass, and Zr: 0.01 to 0.5% by mass may be further added. These additive elements are added for the purpose of preventing the occurrence of casting cracks and color unevenness after anodizing treatment by making the metal structure finely uniform. When any of the elements is excessively added, since a coarse intermetallic compound containing these added elements will be formed, and the above object cannot be achieved, Ti: 0.5% by mass, B: 0.2% by mass and Zr: 0.5% by mass respectively are employed as upper limit values. When the amount added is less than the lower limit value, since the effect of the finely uniform structure cannot be sufficiently obtained, the lower limit value is Ti: 0.01% by mass, B: 0.001% by mass, Zr: 0.01% by mass.

Fe is an impurity element in the present invention because it affects color unevenness and brightness by forming an intermetallic compound, but since, when the content is 0.5% by mass or less, the effect is small, it is allowable to contain.

The method for producing the aluminum alloy of the present invention is not particularly limited as long as the effects of the present invention are not impaired, and various conventionally known production methods may be used.

3. Aluminum Alloy Die-Cast Material

The aluminum alloy die-cast material of the present invention is characterized by being made of the aluminum alloy of the present invention and has a tensile property of 0.2% proof stress of 100 MPa or more. The tensile property of 0.2% proof stress is preferably 105 MPa or more, more preferably 110 MPa or more. Excellent mechanical properties are basically realized by rigorously optimizing the composition, and the mechanical properties are obtained regardless of the shape and size of the die-cast material, and regardless of the part and orientation of the die-cast material.

The aluminum alloy die-cast material of the present invention preferably has a Vickers hardness of 60 or more. When the Vickers hardness of the aluminum alloy die-cast material is 60 or more, it is possible to suppress the deformation at the time of mold release even in the part of the die-cast material where the thickness must be thin, and further the formation of screw holes, etc. and is possible to impart the workability required for precision machining.

In the aluminum alloy die-cast material of the present invention, it is preferable that the granular crystal region formed by the primary crystal α particles having a maximum ferret diameter of 10 μm or more occupies 90% or more of the surface area ratio of the member surface. On the surface of the die-cast material after casting, a granular crystal region having a relatively large particle size of the primary crystal α and a columnar crystal region having a relatively small particle size of the primary crystal α may coexist. The present inventors have found that the fact (1) in the granular crystal region, the incident light tends to be specularly reflected due to the primary crystal α particles, while in the columnar crystal region, since the surface area occupied by each crystal grain becomes small, the incident light tends to be diffusely reflected, and the fact (2) this difference in reflection tendency is remarkably observed after the anodizing treatment, and thus this difference in reflection tendency is the main factor of causing color unevenness in the color development stage of the anodic oxide film. The Color unevenness due to this difference in reflection tendency can be eliminated by making the particle size of the primary crystal α uniform, and when 90% or more of the surface area ratio is occupied by either the granular crystal region or the columnar crystal region on the surface area of the member, the color unevenness after anodizing treatment is suppressed. However, the particle size (maximum ferret diameter) of the primary crystal α particles in the columnar crystal region is as fine as several μm on average, and the amount of the second-phase particles appearing at the grain boundary of the primary crystal α particles is relatively high. The second-phase particles present on the surface of the member are the main factor of the decrease in brightness in the anodizing treatment and also inhibit the coloring in the dyeing treatment. Therefore, in order to avoid the color unevenness while maintaining good brightness after anodizing treatment, it is effective that the granular crystal region formed by primary crystal α particles having a maximum ferret diameter of 10 μm or more occupies a surface area ratio of 90% or more on the surface of the member. The granular crystal region can be discriminated with naked eyes after the anodizing treatment. From this point of view, in order to expose the homogeneous primary crystal α particles which exist inside the die-cast material to the surface, it is one of the effective solutions to perform surface cutting of about 1 mm on the die-cast material and then perform anodizing treatment.

However, since the advantage of the die-cast material over the members obtained by other construction methods such as wrought material is that the shape of the die-cast material is close to that of the product when the casting is completed, when performing the face-cutting the die-cast material having a complicated shape, the cost advantage over other construction methods is at least partially lost. Therefore, there is a great demand for a photoluminescent aluminum alloy die-cast that does not have uneven color development even when anodizing treatment is performed without surface cutting.

On the other hand, it has also been confirmed that the aluminum alloy die-cast material of the present invention can be provided with an anodic oxide film having high brightness and uniform color development without surface cutting, and this is caused by using the aluminum alloy composition of the present invention, from the great effects of forming primary crystal α particles having a uniform and sufficiently large particle size (maximum ferret diameter) on the surface of the die-cast material and of defining the amount of precipitation of various intermetallic compounds, and the like.

Here, the method for obtaining the maximum ferret diameter of the primary crystal α particles is not particularly limited, and measurement may be performed by various conventionally known methods. The ferret diameter is the length of the side of the rectangle circumscribing the particles, and the maximum ferret diameter of a certain crystal particle is the longest length of the long side when changing the angle of the circumscribing rectangle. By observing the surface of the aluminum alloy die-cast material with an optical microscope or a scanning electron microscope, the maximum ferret diameter of each primary crystal α is measured. Depending on the observation method, the cross-sectional sample may be subjected to mechanical polishing, buffing, electrolytic polishing, etching or the like.

The shape and size of the aluminum alloy die-cast material are not particularly limited as long as the effects of the present invention are not impaired, and they can be used as various conventionally known members. Examples of the member include an electronic terminal housing.

4. Method for Manufacturing Aluminum Alloy Die-Cast Material

The method for manufacturing the aluminum alloy die-cast material of the present invention is not particularly limited as long as the effect of the present invention is not impaired, and the aluminum alloy of the present invention can be subjected to die casting by various conventionally known methods.

As the die casting conditions, for example, the casting pressure may be 80 to 150 MPa, the molten metal temperature may be 680 to 780° C., and the mold temperature may be 130 to 200° C. In manufacturing of the aluminum alloy die-cast material of the present invention, it is preferable to perform heat treatment, and more preferable to perform T5 treatment. However, during the heat treatment, if porosity due to entanglement cavities and shrinkage cavities exists in the die-cast material at a certain level or more, surface defects such as blisters may occur due to gas expansion during the heat treatment. Therefore, it is desirable to use a vacuum die-cast method, a PF die-cast method, or the like to obtain a die-cast material having reduced porosity.

5. Aluminum Alloy Die-Cast Material with Anodic Oxide Film

The aluminum alloy die-cast material with the anodic oxide film of the present invention is obtained by subjecting the aluminum alloy die-cast material of the present invention to anodizing treatment and is characterized by having the appearance of uniform and beautiful color tone. Hereinafter, the aluminum alloy die-cast material with the anodic oxide film will be described in detail.

The aluminum alloy die-cast material with the anodic oxide film of the present invention is characterized in that, in the color measurement of the surface with an anodic oxide film of about 5 μm formed without dyeing by using a sulfuric acid bath, when using the CIE standard illuminant D65 as the light source, the L* value is 70 or more, the a* value is 0 to 2, and the b* value is 1 to 4. Here, as the surface color measurement method, the method defined in JISZ8781 may be employed.

Further, the aluminum alloy die-cast material with the anodic oxide film of the present invention is characterized in that the occurrence of color unevenness is highly suppressed. Here, with respect to the method of detecting color unevenness, for example, in the reflectance measurement, if the reflectance is significantly different depending on the part, it is naturally recognized as color unevenness by the human eye, but on the other hand, even if the same reflectance is obtained at the whole sites, since the light incident on the part where the average particle size of the primary crystal α particles is small and the intermetallic compound is densely present tends to be diffusely reflected, and the light incident on the part where the average particle size of the primary crystal α particles is large and the intermetallic compound is coarsely present tends to be specularly reflected, this difference is recognized as color unevenness in observation by the human eye. Further, in the color measurement of the a* value and the b* value, if the a* value and the b* value are significantly different depending on the part, the difference can be discriminated by the human eye and recognized as color unevenness. Accordingly, there are various reasons for people to identify color unevenness, and there is no appropriate index. Therefore, it is appropriate to visually check for color unevenness.

6. Anodizing Treatment of Aluminum Alloy Die-Cast Material

In the following, the method of anodizing treatment of the aluminum alloy die-cast material will be described in detail. It should be noted that it is not necessary to include all of these steps in the embodiments of the invention, and it is possible to select and carry out the steps as necessary, for example, the following surface cutting treatment being omitted in consideration of the manufacturing cost.

(1) Surface Cutting Treatment

In the surface layer of the aluminum alloy die-cast material, there is a case that granular and columnar particles may coexist as the crystallization form of the primary crystal α particles, and, when viewed macroscopically, the non-uniformity of the crystallization form of the primary crystal α particles may adversely affect the subsequent anodizing treatment and dyeing treatment. The non-uniformity of the crystallization form of the primary crystal α particles can be solved by surface cutting to a depth of about 1 mm from the surface of the aluminum alloy die-cast material.

(2) Blast Treatment

This is a treatment in which hard fine particles are made to collide with the aluminum alloy die-cast material to roughen the surface. By applying the blast treatment, the metal structure after the anodizing treatment can be made inconspicuous. As the blast treatment conditions, known conditions may be used, for example, by using fine particles having a particle size of 80 to 400 μm composed of $ZrO_2$, $SiO_2$, or the like, and applying the injection pressure of 0.2 to 0.6 MPa.

(3) Degreasing Treatment

This is the treatment to remove oil and dust on the surface of the aluminum alloy die-cast material. As the degreasing treatment conditions, known conditions may be used, for example, by using a halogenated hydrocarbon as a solvent, after a shower at a temperature of 72° C. or higher for about 10 seconds, and performing the steam injection for about 1 minute.

(4) Oxide Film Removal Treatment

This is a treatment to remove the oxide film formed on the surface of the aluminum alloy die-cast material. As the conditions of the oxide film removal conditions, known conditions may be used, for example, by using $HNO_3$ having a concentration of 200 g/l as a bath solution, and immersing at room temperature for about 1 minute.

(5) Etching Treatment

This is a treatment that removes fine scratches and stains which cannot be removed by the degreasing treatment by melting the surface of the aluminum alloy die-cast material. As the etching treatment conditions, known conditions may be used, for example, by using a 50 g/l NaOH aqueous solution and immersing at room temperature for about 1 minute.

(6) Desmutting Treatment

This is a treatment to remove oxides and the like which are present on the surface of the aluminum alloy die-cast material. As the desmutting treatment conditions, known conditions may be used, for example, by using $HNO_3$ having a concentration of 200 g/l as a bath solution, immersing at room temperature for about 1 minute, and irradiating with ultrasonic waves.

(7) Chemical Polishing Treatment

This is a treatment that gives a glossy feeling to the surface of the aluminum alloy die-cast material by melting the surface of the aluminum alloy die-cast material. As the chemical polishing treatment conditions, known conditions may be used, for example, by immersing in a mixed solution of phosphoric acid and nitric acid at 95° C. for about 5 minutes.

(8) Anodizing Treatment

This is a treatment for forming an anodic oxide film on the surface of the aluminum alloy die-cast material. As the anodizing treatment conditions, known conditions may be used, for example, by using $H_2SO_4$ having a concentration of 180 g/l as a solution, and subjecting to energization treatment at a solution temperature of 18° C., the current density of 150 A/m$^2$ for 33 minutes and 20 seconds.

(9) Dyeing Treatment

This is a treatment to color by infiltrating organic dyes and the like into the fine pores of the anodic oxide film. As the dyeing treatment conditions, known conditions may be used. When imparting a dark color, it is common to immerse in an aqueous solution adjusted to a high concentration of an organic dye for a long time, and when imparting a light color, it is common to immerse in an aqueous solution adjusted to a low concentration of an organic dye for a short time. When this treatment is omitted, the color of the anodic oxide film itself is mainly reflected in the color tone and texture of the die-cast material.

(10) Pore Sealing Treatment

This is a treatment to close the fine pores which are present in the anodic oxide film. As the pore sealing treatment conditions, known conditions may be used, for example, by using a nickel acetate-based pore-sealing agent as a solution, and immersing in the solution of 95° C. for about 30 minutes.

Though the typical embodiments of the present invention have been described above, the present invention is not limited to these, and various design changes are possible, and all of these design changes are included in the technical scope of the present invention.

EXAMPLES

Example 1

In Table 1, an aluminum alloy having the composition described as Example 1 was melted and produced, and die casting was performed at the casting pressure of 120 MPa, the molten metal temperature of 730° C. and the die temperature of 170° C. The die shape is a plate shape of 55 mm×110 mm×3 mm. The unit of the numerical values shown in Table 1 is % by mass concentration.

TABLE 1

| | Mn | Mg | W | Zn | Ti | Cu | Fe | Zn | Al |
|---|---|---|---|---|---|---|---|---|---|
| Ex. 1 | 1.4 | 1.0 | 0.08 | 2.0 | 0.05 | — | — | — | Bal. |
| Com. Ex.1 | 1.4 | — | 0.08 | — | 0.05 | — | — | — | Bal. |
| Com. Ex.2 | 2.2 | 1.0 | 0.08 | — | 0.07 | — | — | — | Bal. |
| Com. Ex.3 | 0.18 | 0.12 | — | 10.22 | 0.04 | 2.65 | 0.81 | 0.48 | Bal. |

When the No. 14B test piece specified in JIS-Z2241 was collected from the obtained aluminum alloy die-cast material and subjected to a tensile test at room temperature, the 0.2% proof stress and Vickers hardness were as shown in Table 2.

TABLE 2

| | 0.2% proof stress (Mpa) | Vickers hardness (HV) |
|---|---|---|
| Ex. 1 | 111 | 77 |
| Com. Ex.1 | 62 | 38 |
| Com. Ex.2 | 94 | 60 |
| Com. Ex.3 | 150 | 82 |

The obtained aluminum alloy die-cast material was subjected to the blast treatment by using fine particles having a particle size of 125 to 250 μm composed of $ZrO_2$, $SiO_2$, or the like, and applying the injection pressure of 0.4 MPa, the degreasing treatment by using a halogenated hydrocarbon as a solvent, after a shower at a temperature of 72° C. for about 10 seconds, and performing the steam injection for about 1 minute, the desmutting treatment by using $HNO_3$ having a concentration of 200 g/l as a bath solution, immersing at room temperature for about 1 minute, and irradiating with ultrasonic waves, the chemical polishing treatment by immersing in a mixed solution of phosphoric acid and nitric acid at 95° C. for about 5 minutes, the anodizing treatment by using $H_2SO_4$ having a concentration of 180 g/l as a solution, and subjecting to energization treatment at a solution temperature of 18° C., the current density of 150 A/m$^2$ for 33 minutes and 20 seconds, and the pore sealing treatment by using a nickel acetate-based pore-sealing agent as a solution, and immersing in the solution of 95° C. for about 30 minutes, in this order to obtain an aluminum alloy die-cast material with an anodic oxide film.

The L* value, a* value, and b* value (CIELab color space) of the obtained aluminum alloy die-cast material with the anodic oxide film were measured by the color measuring method specified in JISZ8781. Further, the presence or absence of color unevenness was determined with the naked eyes, and evaluated according to the rule where when there was no color unevenness, ○ was given, when there was slight color unevenness, Δ was given, and when there was some color unevenness, × was given. In addition, with respect to the region where the presence or absence of color unevenness was visually evaluated, the evaluation was performed whether or not the granular crystal region exceeded 90% of the surface area of the member. Specifically, after removing the anodic oxide film in the target region by polishing, etching was performed and then observation was performed with an optical microscope. In addition, the granular crystal region was identified from the obtained photograph of the optical microscope, and the area ratio with respect to the entire observed image was calculated. When the area ratio of the granular crystal region exceeded 90%, it was judged as ○, and when did not exceed, it was judged as ×.

TABLE 3

| | Light source | L* | a* | b* | Evaluation of granular crystal area | Color unevenness |
|---|---|---|---|---|---|---|
| Ex. 1 | D65 | 83.76 | 0.68 | 2.12 | ○ | ○ |
| Com. Ex.1 | D65 | 82.26 | 0.87 | 2.96 | ○ | ○ |
| Com. Ex.2 | D65 | 82.75 | 0.8 | 2.59 | x | Δ |
| Com. Ex.3 | D65 | 36.56 | 0.62 | 2.59 | x | x |

Comparative Example 1

A test piece was collected in the same manner as in Example 1 except that the melting material was adjusted so as to have the components described as Comparative Example 1 in Table 1, and when the 0.2% proof stress was measured, the values shown in Table 2 were obtained.

Further, as a result of anodizing treatment and color measurement under the same conditions as in Example 1, evaluations of L* value, a* value, b* value (CIELab color space), color unevenness, and granular crystal region were the values shown in Table 3.

Comparative Example 2

A test piece was collected in the same manner as in Example 1 except that the melting material was adjusted so as to have the components described as Comparative Example 2 in Table 1, and when the 0.2% proof stress was measured, the values shown in Table 2 were obtained.

Further, as a result of anodizing treatment and color measurement under the same conditions as in Example 1, evaluations of L* value, a* value, b* value (CIELab color space), color unevenness, and granular crystal region were the values shown in Table 3.

Comparative Example 3

As a result of anodizing treatment and color measurement under the same conditions as in Example 1 except that the melting material was adjusted so as to have the components described as Comparative Example 3 in Table 1, evaluations of L* value, a* value, b* value (CIELab color space), color unevenness, and granular crystal region were the values shown in Table 3. The composition of Comparative Example 3 corresponds to ADC12.

From Table 2, the aluminum alloy die-cast material of the present invention has both a tensile property of 0.2% proof stress of 100 MPa or more and a hardness of 60 HV or more. On the other hand, though the aluminum alloy die-cast material of Comparative Example 3 has a high tensile property of 0.2% proof stress and Vickers hardness, the aluminum alloy die-cast materials of Comparative Examples 1 and Comparative Example 2 have a tensile property of 0.2% proof stress of less than 100 MPa and the hardness of less than 60 HV.

Further, from Table 3, the aluminum alloy die-cast material with the anodic oxide film of about 5 μm of the present invention has the values within the range where the L* value is 70 or more, the a* value is 0 to 2, and the b* value is 1 to 4, in the color measurement of the surface of the anodic oxide film, when using the CIE standard illuminant D65 as the light source. On the other hand, the aluminum alloy die-cast materials of the comparative examples with the anodic oxide film of about 5 μm has the a* value and the b* value within the range, but in Example 3, the L* value is significantly low.

From the above results, it is understood that, in an aluminum alloy containing an appropriate amount of tungsten, an aluminum alloy die-cast material having 0.2% proof stress of 100 MPa or more, and hardness of 60 HV or more, in addition to good brightness (L* value), hue and saturation (a* value, b* value), no color unevenness is only the aluminum alloy die-cast material of Example 1 where the addition amounts of Mn, Mg and Zn which are elements that improve the mechanical properties of the aluminum alloy die-cast material are strictly controlled.

The invention claimed is:

1. An aluminum alloy comprising:

Mn: 0.5 to 3.0% by mass,

Mg: 0.3 to 2.0% by mass,

W: 0.01 to 1.0% by mass,

Zn: 1.5 to 2.5% by mass, with the remainder comprising aluminum and unavoidable impurities, wherein the aluminum alloy further contains one or more selected from the group consisting of:

Ti: 0.01 to 0.5% by mass,

B: 0.001 to 0.2% by mass, and

Zr: 0.01 to 0.5% by mass.

2. The aluminum alloy according to claim 1, wherein a content of the Mn is 1.0 to 2.0% by mass, and a content of the Mg is 0.5 to 1.5% by mass.

3. An aluminum alloy die-cast material comprising the aluminum alloy according to claim 1, which has a tensile property of 0.2% proof stress of 100 MPa or more.

4. The aluminum alloy die-cast material according to claim 3, wherein a Vickers hardness is 60 or more.

5. The aluminum alloy die-cast material according to claim 3, wherein a granular crystal region formed by primary crystal α particles having a maximum ferret diameter of 10 μm or more occupies 90% or more of the surface area ratio of the member surface.

6. The aluminum alloy die-cast material according to claim 3, which is provided with an anodic oxide film of about 5 μm formed by anodizing treatment without dyeing by using a sulfuric acid bath, and, in the color measurement of the surface of the anodic oxide film, when using the CIE standard illuminant D65 as the light source, the L* value is 70 or more, the a* value is 0 to 2, and the b* value is 1 to 4.

* * * * *